US005373678A

United States Patent [19]

Hesser

[11] Patent Number: 5,373,678

[45] Date of Patent: Dec. 20, 1994

[54] STRUCTURAL PANEL SYSTEM

[76] Inventor: Francis J. Hesser, P.O. Box 916, Demopolis, Ala. 36732

[21] Appl. No.: 199,946

[22] Filed: Feb. 22, 1994

[51] Int. Cl.[5] ..... E04C 1/10

[52] U.S. Cl. ..... 52/592.1; 52/592.3; 52/309.2; 52/309.9; 52/483.1

[58] Field of Search ..... 52/578, 589.1, 592.1, 52/592.2, 592.3, 483.1, 793, 309.7, 309.9, 592.4, 584.1, 309.16, 309.14, 309.2, 309.4

[56] References Cited

U.S. PATENT DOCUMENTS

| | | | |
|---|---|---|---|
| 2,447,272 | 8/1948 | Parkes | 52/578 |
| 2,739,677 | 3/1956 | Greulich | 52/578 |
| 2,891,638 | 6/1959 | Grundy | 52/578 |
| 3,469,873 | 8/1966 | Glaros . | |
| 3,535,844 | 7/1968 | Glaros . | |
| 4,100,710 | 7/1978 | Kowallik | 52/309.9 |
| 4,143,498 | 3/1979 | Martin, Jr. et al. . | |
| 4,177,615 | 12/1979 | Anderson | 52/309.9 |
| 4,283,897 | 8/1981 | Thompson . | |
| 4,316,351 | 2/1982 | Ting | 52/309.9 |
| 4,379,480 | 4/1983 | Kempel et al. | 52/309.9 |
| 4,435,934 | 3/1984 | Kim | 52/483.1 |
| 4,546,590 | 10/1985 | Finch et al. . | |
| 4,575,981 | 3/1986 | Porter . | |
| 4,790,112 | 12/1988 | Wang . | |
| 4,936,069 | 6/1990 | Hunter et al. | 52/309.9 |
| 4,936,078 | 6/1990 | Porter | 52/592.1 |
| 5,228,257 | 7/1993 | Bowersox et al. . | |

*Primary Examiner*—Michael Safavi
*Assistant Examiner*—Wynn E. Wood
*Attorney, Agent, or Firm*—William M. Hobby, III

[57] ABSTRACT

A structural wall apparatus includes a plurality of building panels disposed in edge to edge relationship with each panel being connected to the adjacent abutting panel. Each panel has outer and inner metal skin spaced by an intermediate insulating core of foamed polymer. Each panel has at least one interlocking edge having a metal lined tongue and a metal lined groove shaped for each metal tongue to fit into opposing grooves on abutting panels for interlocking the panels together. Each panel has an elongated reinforcing member positioned adjacent the interlocking edge of the panel and has a channel formed therein shaped to fit around the metal lined groove portion and also has a skin attaching flange on one side for attaching the reinforcing member to the metal skin and a strengthening flange portion on the other side of the metal lined groove. A plurality of panel connecting fasteners attaches the panels together by having one elongated fastener passing through the panel skin and through the elongated reinforcing member skin attaching flange and through the reinforcing member channel and through the metal lined groove and the metal lined tongue of the second panel and through the elongated reinforcing member strengthening flange on the other side of the metal lined groove to provide greater strength to the connecting edges of the attached panels.

9 Claims, 2 Drawing Sheets

STRUCTURAL PANEL SYSTEM

BACKGROUND OF THE INVENTION

The present application deals with a structural wall and especially to a structural wall having abutting structural panels with improved reinforced panel edge connections.

In the past, it has been common to provide a wide variety of modular building panels including prefabricated panels of all types. One common type of building panel includes a pair of planar surfaces, such as sheet metal surfaces, spaced by a foamed polymer, such as polystyrene or polyurethane, which provides a lightweight panel of great strength. Other panels have used honeycomb material spaced by planar surfaces to provide a lightweight panel of great insulation. There have been a variety of techniques for attaching prefabricated panels of this type together and typically these involve a tongue that is inserted into a groove along the abutting edges of two panels and then locking the two panels together. Since the tongue and groove are typically metal, a complete seal against air currents and, as a result, various techniques have been developed for providing additional seals including caulking the connection as well as various types of rubber seals.

Typical prior art patents of the present type having various types of connections between abutting edges of panels may be seen in the U.S. patents to Glaros, U.S. Pat. No. 3,535,844, for a structural panel having metal skin spaced by an insulating material and having a pair of tongues oppositely inserted into a pair of grooves with one of the panels being anchored through its skin to the framework of a building. A second Glaros U.S. Pat. No. 3,469,873 shows other ways of joining planar connecting members. In the Martin, Jr. et al. patent, U.S. Pat. No. 4,143,498, a concealed fastener clip for building panels is shown in which building plans having a pair of metal skin surfaces spaced by an insulating material and is provided with a connecting clip which is bolted to a framework and which fits within the groove of one panel for a tongue to slip thereinto from another panel. The Porter patent, U.S. Pat. No. 4,575,981, shows a roof panel construction in which the panels have off-setting edges which mesh to interconnect the panels which are then sealed with a threaded fastener inserted through a pair of engaging tongues, one from each of the abutting edges of the panels. The Finch et al. patent, U.S. No. 4,546,590, shows a partition wall system and components for the system in which the partitioning walls are connected with a threaded fastener through interconnecting abutting edges of the partitions. The Thompson patent, U.S. Pat. No. 4,283,897, is a snap action panel wall construction having clips bolted to a support for holding a panel wall to a spaced supporting member or framework and includes a seal placed between the abutting panels. The Wang patent, U.S. Pat. No. 4,790,112, shows an assembly for two interconnected similar plastic planks to a framework in which a threaded fastener is driven through a pair of meshed tongues on abutting panels. The Bowersox et al. patent, U.S. Pat. No. 5,228,257, shows a modular wall system having abutting panels with inner meshed tongues which are locked together with a fastener member passing through the tongues and caulks the edges of the panel for a complete seal.

In contrast to these prior art systems, the present invention is directed towards structural insulating panels which have the abutting edges joined with interconnecting tongue and grooves but which includes specially designed reinforcing members placed along interconnecting edges and wrapping around metal lined grooves. The attaching fasteners can connect through both the tongue and groove to lock the panels together while simultaneously locking through the reinforced members four times to greatly increase the strength both of the interconnection and of the wall system. The interconnecting member can also be driven through a metal header supporting the panels together and providing a surface for attaching the roofing panels.

SUMMARY OF THE INVENTION

A structural wall apparatus includes a plurality of building panels disposed in edge to edge relationship with each panel being connected to the adjacent abutting panel. Each panel has outer and inner metal skins spaced by an intermediate insulating core of foamed polymer. Each panel has at least one interlocking edge having a metal lined tongue and a metal lined groove shaped for each metal tongue to fit into opposing grooves on abutting panels for interlocking the panels together. Each panel has an elongated reinforcing member positioned adjacent the interlocking edge of the panel and has a channel formed therein shaped to fit around the metal lined groove portion and also has a skin attaching flange on one side for attaching the reinforcing member to the metal skin and a strengthening flange portion on the other side of the metal lined groove. A plurality of panel connecting fasteners attaches the panels together by having one elongated fastener passing through the panel skin and through the elongated reinforcing member skin attaching flange and through the reinforcing member channel and through the metal lined groove and the metal lined tongue of the second panel and through the elongated reinforcing member strengthening flange on the other side of the metal lined groove to provide greater strength to the connecting edges of the attached panels. Additional fasteners attach the panels to a frame and also attach the elongated reinforcing member to the metal skin of a panel. Fasteners are also used to attach the panels to an elongated metal head or plate attaching the panels together and having an angled surface for attaching a plurality of roofing panels.

BRIEF DESCRIPTION OF THE DRAWINGS

Other objects, features, and advantages of the present invention will be apparent from the written description and the drawings in which.

DESCRIPTION OF THE PREFERRED EMBODIMENTS

Figure 1:
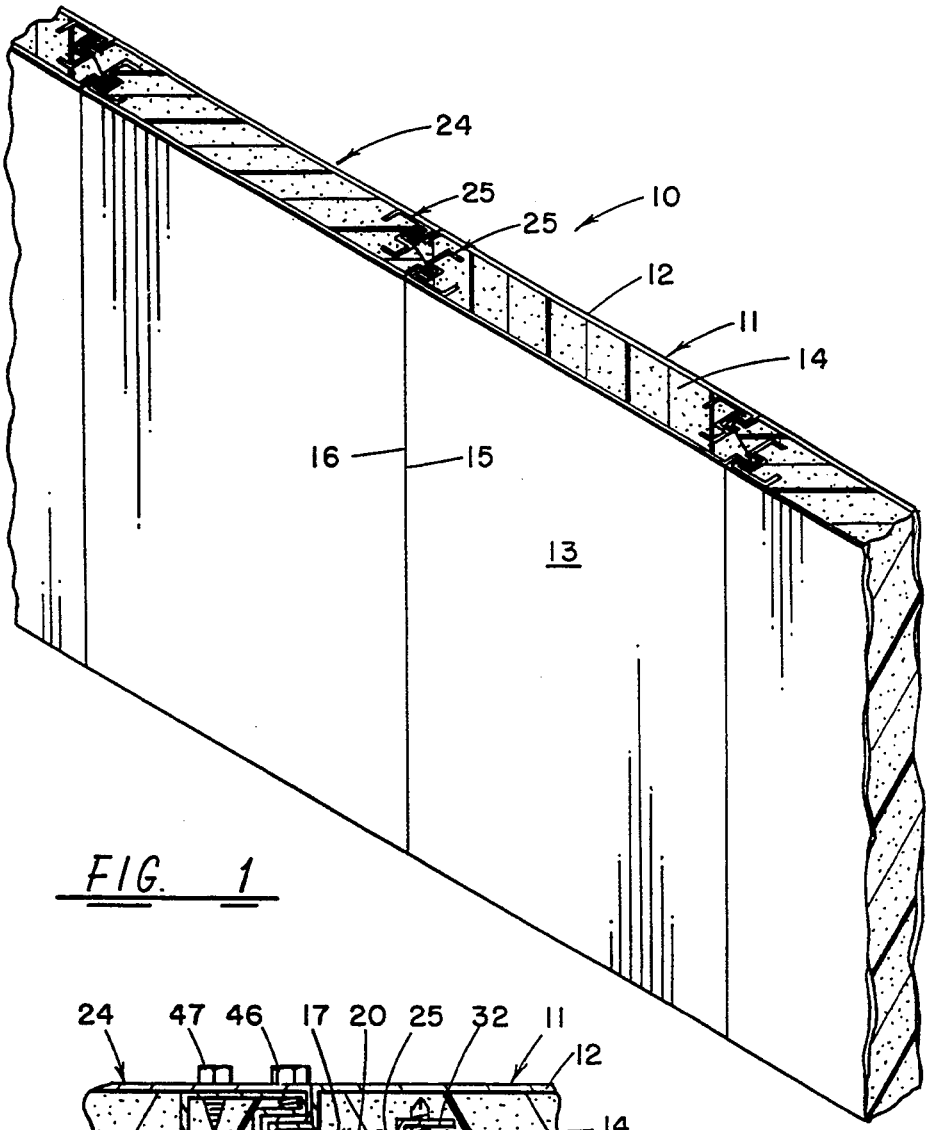
FIG. 1 is a perspective view of a structural wall made up of a plurality of interconnecting panels.

Referring to the drawings and especially to FIGS. 1–4, a structural and insulated wall 10 has a plurality of panels 11 interconnected to each other. Each panel has an outer skin 12 and an inner skin 13 spaced by a uniform thick insulating material 14 which may be a foamed polymer, such as a polystyrene or polyurethane rigid foam, to form a lightweight structural panel 11. Each panel has abutting attaching ends 15 and 16 with the end 15 having a metal lined tongue 17 and a metal lined groove 18 in which the metal lining continues from the inner and outer skins 12 and 13. However, the tongue 17 in the groove 18 are spaced from each other to leave an angled insulating material 20 which, when the panels are connected, will press against the insulating material 21 of the next adjacent panel. The panel end 16 has a metal lined groove 22 which exactly coincides and coacts with the tongue 17 and has a tongue 23 which coacts with the metal lined groove 18. Thus, when two panels 11 and 23 are connected, the tongue 17 is inserted into the groove 22 while the tongue 23 is inserted into the groove 18 bringing the exposed insulation 20 and 21 together to provide the seal from the soft flexible material.

Figure 3:
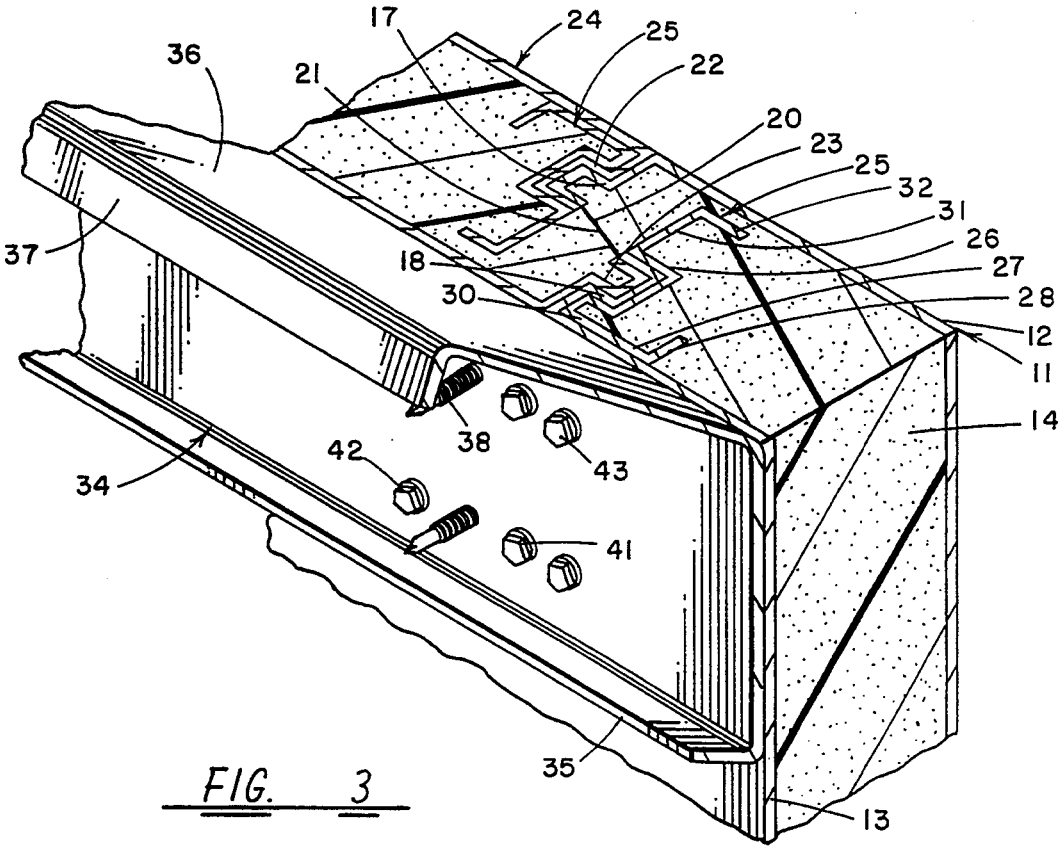
FIG. 3 is a cut-away perspective view showing the connection of a pair of connected panels with an attached header.
Figure 4:
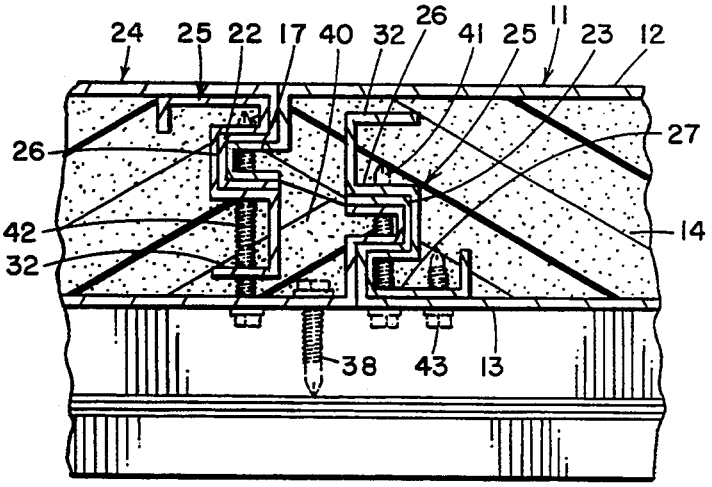
FIG. 4 is a sectional view of the connection of interconnecting panels.

At this point, the abutting edge interconnection of the panels is similar to that shown in some of the prior art panels but is improved by an elongated reinforced metal member 25 which may be a steel or heavy aluminum reinforcing member which has a channel portion 26 formed to fit around the metal lined groove 18 in the back thereof so that the groove 18 is lined all the way around by the reinforcing member 25 which then has an inner skin attaching portion 27 formed along the inner skin 13 of the panel 11 and has an additional perpendicular extending flange 28. There is a second smaller "W" channel 30 in the reinforcing member 25 and a larger U-shaped portion 31 having an end flange portion 32. Thus, the reinforcing member 25 forms a channel facing lengthwise of the panels as well as transverse to the panels to greatly strengthen the panel in both directions when the panel and reinforcing members are anchored together to a structure as shown in FIGS. 3 and 4. The panels are interconnected to a header member 34 having a bottom flange 35 and an angled top surface 36 with a downward flange 37. An elongated header flange 34 has each panel connecting at the connecting point with a fastener 38 attached through the insulation portion 40 and into the header 34. The threaded elongated fasteners 41 are passed through the inner skin 13 and through the skin attaching portion 27 of the elongated metal reinforcing member 25. Fasteners 41 also pass through the reinforcing member 25, channel portion 26 on both sides and through both sides of the tongue 23 from the adjacent panel 24. Similarly, a metal fastening member 42 passes through the skin of panel 24 and through the flanged portion 32 of the reinforcing member 25 and through the channel portion 26 of the reinforcing member on both sides and through the metal lined groove 22 of the panel 24 and through the metal lined tongue 17 of the panel 11. Thus, the metal fasteners 41 and 42 are passing through the reinforcing members 25 three times and through at least two metal groove surfaces and two metal tongue surfaces to lock the panels together in a greatly strengthened connection as well as to provide greater strength to the panels. The elongated reinforcing members 25 can be seen to be identical for each panel and also to be of a greater thickness than the metal skin on the panel.

As seen in FIG. 3, the fasteners 41 and 42 can also be locked through the metal head of 34 to lock the panels to the metal header 34 to thereby further bind the panels to each other and to the reinforcing members 25 to hold the header 34 with much greater strength. In addition, a plurality of short fasteners 43 can be seen further anchoring the skin attaching portion 27 of the metal reinforcing members 25 to the inner metal skin 13. The fasteners may all be threaded self-tapping screws of different lengths as required for anchoring the panels together into the header.

Figure 5:
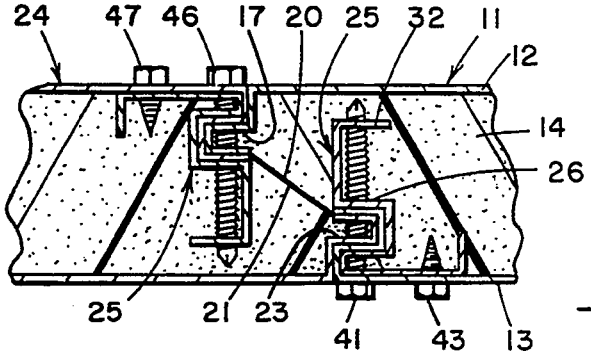
FIG. 5 is a sectional view of an alternate embodiment of the connection of a pair of connected panels.
Figure 2:
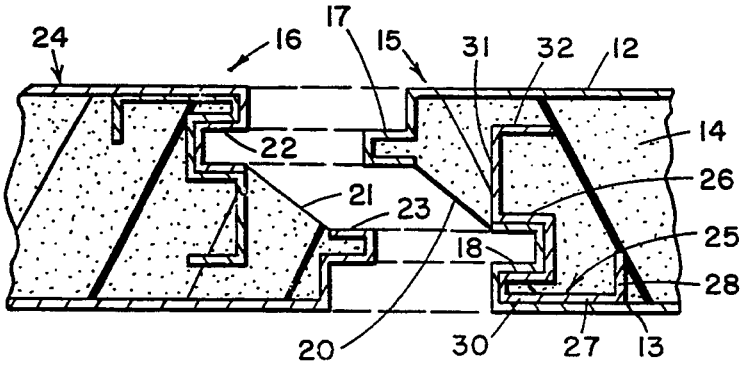
FIG. 2 is a sectional view of a separated pair of abutted panels edges.

FIG. 5 shows a slightly modified embodiment in which panels 11 and 24 are interconnected and have the same reinforcing members 25. The panels having the same shape with an insulating polymer foam core 14 spacing a pair of metal skins 12 and 13 and having the fasteners 43 attached through the skin attaching portion 27 and through the channel portion 26 and flange portion 32 of the reinforcing members 25 and through the tongue 23 of one panel. The second panel, however, is anchored together with a threaded fastener 46 similar to the fastener 41 but connected from the other side of the panel. The shorter self-tapping threaded fastener 47 is similar to the fastener 43 but is attached on the opposite side of the panel 24 from that of panel 11. Fastener 46 passes through the reinforced member 25 in the same manner as that for panel 11 but from the opposite side and, in addition, passes through the flanged portion 32 on both sides to allow the locking together of the panels.

It should be clear at this point that a structural wall and panel system and especially a panel connecting system has been provided which greatly strengthens both the rigidity of the panels as well as the connection between the panels and the connection of the panels to the header and to the framework for a prefabricated type building. However, the present invention is not to be construed as limited to the forms shown which are to be considered illustrative rather than restrictive.

I claim:

1. A structural wall comprising:

a plurality of building panels disposed in edge to edge relationship, each said panel having an interlocking edge and an outer metal skin and an inner metal skin and an intermediate insulating core spacing said outer and inner metal skins apart a predetermined distance, said interlocking edge of each panel having a metal lined tongue and a metal lined groove with said tongue fitting into the groove of an abutting panel interlocking therewith whereby one edge of each panel interlocks with one edge of a second panel, and each said panel having an elongated reinforcing member positioned adjacent said interlocking edge of each panel and having a channel formed therein shaped to fit around said metal lined groove and having a skin attaching portion on one side of said panel metal lined groove and a flanged portion on the other side of said metal lined groove;

a plurality of panel connecting fastening members attaching said panels together, each said first fastening members including an elongated fastener attaching through one panel skin and through said elongated reinforcing member skin attaching portion and through said metal lined groove and through the metal lined tongue of a second panel and through said elongated reinforcing member channel around said metal lined groove and through said flanged portion of said elongated reinforcing member on the other side of said metal lined groove, whereby interconnecting panels are attached together and supported with greater strength.

2. A structural wall in accordance with claim 1 including a plurality of skin fasteners fastening said elongated reinforcing member to said panel inner metal skin.

3. A structural wall in accordance with claim 2 including a metal header plate attached to the inner metal skin of each said panel for supporting adjacent panels together.

4. A structural wall in accordance with claim 3 in which said metal header plate has an angled attaching surface thereon extending at an angle to each said panel.

5. A structural wall in accordance with claim 4 in which each said panel insulating core is a foamed polymer insulation material which extends to said interlocking edge of each panel to form a seal between adjacent attached panels.

6. A structural wall in accordance with claim 5 in which a plurality of header threaded fasteners attaches said metal header plate to each said panel.

7. A structural wall in accordance with claim 6 in which said skin fasteners are threaded self tapping fasteners.

8. A structural wall in accordance with claim 7 in which said elongated reinforcing member is of greater thickness than the metal in said metal lined groove.

9. A structural wall in accordance with claim 8 in which a plurality of panel connecting fastening members are attached through said metal header plate to thereby lock said metal header plate to said elongated reinforcing member and to said panel metal lined tongue and metal lined groove interconnecting a pair of said panels.

* * * * *